US011332809B2

(12) United States Patent
Zhang et al.

(10) Patent No.: US 11,332,809 B2
(45) Date of Patent: May 17, 2022

(54) METHODS AND PROCESS TO IMPROVE MECHANICAL PROPERTIES OF CAST ALUMINUM ALLOYS AT AMBIENT TEMPERATURE AND AT ELEVATED TEMPERATURES

(71) Applicant: Brunel University London, Uxbridge Middlesex (GB)

(72) Inventors: Yijie Zhang, Uxbbridge Middlesex (GB); Shouxun Ji, Uxbridge Middlesex (GB); Yun Wang, Uxbridge Middlesex (GB)

(73) Assignee: BRUNEL UNIVERSITY LONDON, Uxbridge Middlesex (GB)

( * ) Notice: Subject to any disclaimer, the term of this patent is extended or adjusted under 35 U.S.C. 154(b) by 42 days.

(21) Appl. No.: 16/481,092

(22) PCT Filed: Feb. 1, 2018

(86) PCT No.: PCT/GB2018/050295
§ 371 (c)(1),
(2) Date: Jul. 26, 2019

(87) PCT Pub. No.: WO2018/142141
PCT Pub. Date: Aug. 9, 2018

(65) Prior Publication Data

US 2019/0390301 A1 Dec. 26, 2019

(30) Foreign Application Priority Data

Feb. 1, 2017 (GB) ..... 1701667
Aug. 9, 2017 (GB) ..... 1712765

(51) Int. Cl.
*C22C 1/02* (2006.01)
*C22C 21/04* (2006.01)
*C22F 1/043* (2006.01)

(52) U.S. Cl.
CPC ..... *C22C 1/026* (2013.01); *C22C 21/04* (2013.01); *C22F 1/043* (2013.01)

(58) Field of Classification Search
CPC ..... C22C 21/04; C22C 1/026; C22F 1/043
See application file for complete search history.

(56) References Cited

U.S. PATENT DOCUMENTS

| | | | |
|---|---|---|---|
| 8,758,529 | B2 | 6/2014 | Wang et al. |
| 2008/0060723 | A1 | 3/2008 | Doty |
| 2009/0252643 | A1 | 10/2009 | Doty et al. |
| 2014/0017115 | A1 | 1/2014 | Wang et al. |
| 2015/0315688 | A1 | 11/2015 | Doty |

FOREIGN PATENT DOCUMENTS

| | | | |
|---|---|---|---|
| CN | 1 552 931 | A | 12/2004 |
| CN | 105 834 609 | A | 8/2016 |
| CN | 106 086 538 | A | 11/2016 |
| CN | 106 119 620 | A | 11/2016 |
| RU | 2 048 576 | | 11/1995 |
| SU | 584726 | | 6/1992 |

OTHER PUBLICATIONS

Chen Dengbin et al., Mechanism and Kinetic Model of In-situ $TiB_2$/7055A1 Nanocornposites Synthesized under High Intensity Ultrasonic Field, *Journal of Wuhan University of Technology-Mater. Sci. Ed.; Materials Science Edition*, Wuhan University of Technology, Heidelberg, vol. 26, No. 5, Nov. 10, 2011 pp. 920-925, XPo19974830, ISSN: 1993-0437, DOI: 10.1007/S11595-011-0337-7, pp. 920-9021.

Elgallad et al., Development of New Al—Cu Based Alloys Aimed at Improving the Machinability of Automotive Casings, *International Journal of Metalcasting*, 2009, pp. 29-41.

Elgallad et al., Machinability aspects of new Al—Cu alloys intended for automotive casting, Journal of Materials Processing Technology, vol. 210, 2010, pp. 1754-1766.

Wang, Hongming et al., Characterization of $(Al_2O_3)_p$/A1 composites in situ synthesized by direct melt reaction method, *Advanced Materials Research*, vol. 152-153, Oct. 1, 2010, pp. 25-28, XPo55465418, DOI: 10.4028/www.scientific.net/AMR.152-153.25.

PCT International Search Report/Written Opinion, , dated Apr. 25, 2018—PCT/GB2018/050295 filed Feb. 1, 2018.

*Primary Examiner* — Jessee R Roe
(74) *Attorney, Agent, or Firm* — Joseph T. Leone; DeWitt LLP

(57) ABSTRACT

Micro-alloyed aluminium alloys containing complex sub-micro/or nano-sized strengthening phases are provided for use for example in the automotive industry. Existing commercial alloys are treated by adding at least one of the elements from Ni, Ag, Nb, Mo, Ce, La, Y and Sc at a level of more than 0.1 wt. % but less than 0.5 wt. % on top of the existing commercial alloy containing Si, Cu, Mg, Mn, Zn, and at least one type of sub-micron sized or even nano-sized $TiB_2$, TiC and $Al_2O_3$ solid particles at a level of more than 0.05 wt. % but less than 0.5 wt. % in the solidified castings.

7 Claims, 3 Drawing Sheets

METHODS AND PROCESS TO IMPROVE MECHANICAL PROPERTIES OF CAST ALUMINUM ALLOYS AT AMBIENT TEMPERATURE AND AT ELEVATED TEMPERATURES

This invention relates to micro-alloyed aluminium alloys containing complex sub-micro/or nano-sized strengthening phases. More particularly, the present invention relates to the cast aluminium alloys in need of improvement in the tensile strengths and elongation simultaneously at room temperature and/or high temperatures. In this invention, the existing commercial alloys are treated by adding at least one of the elements from Ni, Ag, Nb, Mo, Ce, La, Y and Sc at a level of more than 0.1 wt. % but less than 0.5 wt. % on top of the existing commercial alloy containing Si, Cu, Mg, Mn, Zn, and at least one type of sub-micron sized or even nano-sized $TiB_2$, TiC and $Al_2O_3$ solid particles at a level of more than 0.05 wt. % but less than 0.5 wt. % in the solidified castings.

DESCRIPTION

Figure 1:
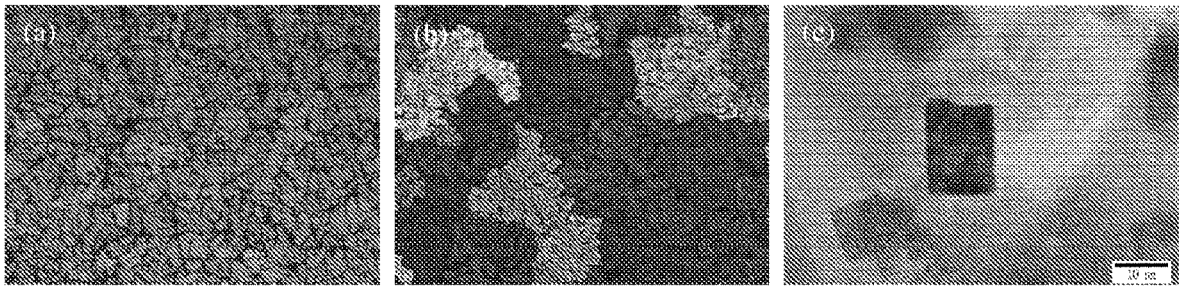
FIG. 1 is a series of photomicrographs showing the grain structure of A356 (panel a), Embodiment 1 (panel b) and the $TiB_2$ particles in Embodiment 1 (panel c).

The present invention relates to method and process to improve the mechanical properties of cast aluminium alloys at both ambient and elevated temperatures. In particular, the said aluminium alloys are commercial alloys preferably containing at least Si, Cu, Mg, Mn and Zn, and the method and process are specially performed through introducing at least one element at a level of more than 0.1 wt. % and less than 0.5 wt % of the element including nickel, silver, niobium, molybdenum, cerium, lanthanum, yttrium, and scandium for enhancing the precipitation strengthening, and also introducing the other elements to form in-situ at least one phase from $TiB_2$, $Al_2O_3$ and/or TiC in the solidified castings to provide secondary phase strengthening without significantly detrimental to the ductility.

Cast aluminium alloys have been widely used in lightweighting structures in automotive and aerospace industry because of the high strength-to-weight ratios, anti-corrosion and good castability. However, the mechanical properties of the currently commercial cast aluminium alloys are not as high as wrought aluminium alloys and other lightweight materials such as Ti-based alloys. Therefore, the improvement of mechanical properties of the commercially available alloys at ambient temperature and elevated temperatures is always demanded by industries. Currently, the general method to improve the mechanical properties of the currently available cast aluminium alloys is through microstructural refinement (the size of both grains and secondary phases), by which the reduced grain size and modified phase morphology can offer an increase in the integrity and mechanical properties of castings. Both chemical and physical approaches can be effective for the grain refinement. Of chemical methods, specially fabricated Al-5Ti-1B master alloy typically at a level of 0.2 wt. % for the master alloy (0.01 wt. % Ti and 0.002 wt. % B) is the most popular commercial grain refiner to refine primary Al grains, while phosphorus and strontium are usually used to refine primary Si phase and eutectic Si phase, respectively. Of physical methods, high cooling rates and enhanced convections are effective for microstructural (grain) refinement. As the most effective strengthening mechanism for aluminium alloys, another method is to add alloying elements to form nano-sized strengthening phases, achieving precipitation strengthening. Although these approaches can provide effective improvement for cast aluminium alloys, there are limitations in reality. For example, the strengthening offered by alloying elements is always accompanied with the scarification of elongation. The positive effect of grain refinement can be cancelled out when working with some specified alloying elements of Mn, Cr, and Zr.

In order to improve the mechanical properties of aluminium alloys for structural applications, significant efforts have been made on the optimisation of both the chemical compositions and the production methods in the past several decades. A number of references have been disclosed in the prior art.

In US2014/0017115A1, a modification of chemical composition of Al—Si alloy is described as 11-13.5% Si, ≤5% Cu, 0.4-0.55% Mg, 0.4% Fe, ≤0.4% Mn, 0.1% Ti, ≤0.5 wt. % Zn, 0.015-0.018% Sr and 0.01-0.05% B with balanced Al. After T6 heat treatment (solution treated at 535±5° C. for 8 hours, aged at 155±5° C. for 3 hours), the average properties of the embodiment alloy containing 11.8% Si, 0.33% Mg, 0.2% Fe, 0.034% Sr and 0.032% B were 345.2 MPa of ultimate tensile strength (UTS) and 13.0% of elongation at ambient temperature. Similarly, after T6 heat treatment, the average properties of the embodiment alloy containing 12.3% Si, 0.41% Mg, 0.25% Cu, 0.15% Fe, 0.026% Sr and 0.032% B were 297.6 MPa of yield strength, 230.5 MPa of UTS, and 11.5% of elongation at ambient temperature. The UTS was 151.5 MPa and elongation was 8.4% at 200° C.

US 2008/0060723 discloses an aluminium alloy with chemical composition of 0.4-2.5% Si, ≤5% Cu, ≤1% Mg, ≤1% Fe, ≤2% Mn, ≤0.3% Ti, ≤2.5% Ni, ≤3% Zn with balanced Al. A 3-step sequential aging (SA) treatment to elevate the tensile properties and ductility at room temperature includes (a) the solutionised and quenched alloy is initially aged at a temperature and quenched to room temperature, and (b) the second stage of aging is conducted at a temperature lower than the temperature in first aging. After heat treatment, the ultimate tensile strength, yield strength, elongation at room temperature are 333.3 MPa, 282.5 MPa and 2.69%, respectively, for one embodiment alloy containing 1.043% Si, 2.13% Cu, 0.48% Mg, 0.42% Fe, 0.73% Mn, 0.011% Sr. After SA treatment, this alloy can provide UTS, YS and elongation at 324.8 MPa, 265.1 MPa and 3.79% respectively. Similarly for an A356 alloy, the UTS is 258 MPa, yield is 234 MPa and elongation is 1.5% under the formal T6 heat treatment. It should be noted that the improvement of elongation is obtained by sacrificing the tensile properties.

In US 2015/0315688A1, a process is provided for producing a castable and heat treatable aluminium alloy with enhanced mechanical strength at room and elevated temperatures via alloying optimization, controlled solidification and heat treatment. The cast alloy includes about 0.6 to about 14.5% silicon, 0 to about 0.7% iron, about 1.8 to about 4.3% copper, 0 to about 1.22% manganese, about 0.2 to about 0.5% magnesium, 0 to about 1.2% zinc, 0 to about 3.25% nickel, 0 to about 0.3% chromium, 0 to about 0.5% tin, about 0.0001 to about 0.4% titanium, about 0.002 to about 0.07% boron, about 0.001 to about 0.07% zirconium, about 0.001 to about 0.14% vanadium, 0 to about 0.67% lanthanum, and the balance predominantly aluminium plus any remainders. Further, the weight ratio of Mn/Fe is between about 0.5 and about 3.5. The UTS at room temperature is 378 MPa, 417 MPa, and 245 MPa under T6, T63-2 and T52 treated conditions, respectively, of the alloy with 1.1% Si, 0.3% Fe, 0.35% Mg, 4.13% Cu, 1.14% Mn, 0.12% Ni, 0.15% Cr, 0.2% Zn, 0.019% Sn, 0.379% Ti, 0.066% B, 0.624% Zr, 0.078% V and 0.032% La. The high temperature property at 250° C. of the alloy with T6, T63-2 and T52 treated was 91 MPa, 182 MPa and 130 MPa, respectively. The improved behaviour at high temperature was ascribed to the thermal-stable and dispersed eutectic phases of $Al_3Ni$, $Al_5FeSi$, $Al_5FeMn_3Si_2$ and other tri-aluminide compounds formed between Sc, Zr, Y, Yb, Er, Ho, Tm, Lu and Al.

In U.S. Pat. No. 8,758,529 B2, a high-temperature aluminium alloy containing tri-aluminide compounds that form a crystallized structure selected from the group consisting of L12, D022 and D023 is disclosed. The alloy consists essentially of about 0 to 2% rare earth elements, about 0.5 to about 14% silicon, about 0.25 to about 2.0% copper, about 0.1 to about 3.0% nickel, approximately 0.1 to 1.0% iron, about 0.1 to about 2.0% zinc, about 0.1 to about 1.0% magnesium, 0 to about 1.0% silver, about 0.01 to about 0.2% strontium, 0 to about 1.0% scandium, 0 to about 1.0% manganese, 0 to about 0.5% calcium, 0 to about 0.5% germanium, 0 to about 0.5% tin, 0 to about 0.5% cobalt, 0 to about 0.2% titanium, 0 to about 0.1% boron, 0 to about 0.2% zirconium, 0 to 0.5% yttrium, 0 to about 0.3% cadmium, 0 to about 0.3% chromium, 0 to about 0.5% indium, and the balance aluminium.

Al—Cu alloys intended for automotive castings are disclosed in Journal of Materials Processing Technology, Vol., 210, 2010, E M Elgallad, "Machinability aspects of new Al—Cu alloys intended for automotive casting", pp. 1754-1766. Although this reference uses Al 5% Ti 1% B, this is for grain refining and is not used in sufficient amounts for there to be sufficient boron present in the final alloy. Accordingly, there is no $TiB_2$ present.

CN 106086538 (University of Shanghai Jiaotong) discloses a cast hypoeutectic Al—Si alloy made by melting aluminium to which silicon, magnesium, copper, iron, zirconium, vanadium, $KBF_4$ and $K_2TiF_6$ are added.

CN 1552931 (University of Shanghai Jiaotong) discloses a high dampling TiC/Al composite material and its preparation.

US 2009/0252643 (Doty et al.) discloses the addition of alloying elements to low-silicon aluminium-based casting alloys in order to eliminate hot tear defects.

SU 584726 (Dobatkin) discloses an aluminium-based alloy which comprises zinc, magnesium, zirconium, beryllium, copper, at least one of titanium, manganese & chromium and alumina.

Although the above-mentioned alloys can provide improved mechanical properties, further improvement is still needed. This is particularly necessary for the improvement of the existing alloys because these alloys were developed several decades ago and the requirement of mechanical properties for the cast aluminium alloys have progressed in the past several decades. For industry applications particularly in automobile and aerospace, the benefits will become more obvious if the yield strength of cast aluminium alloys can be increased by 20% at room temperature and high temperature of 250° C. while the elongation is still maintained at a same level in comparison with the existing alloys.

On the other hand, the existing cast aluminium alloys are relatively sensitive to the wall thickness of castings. For example, the commercial A356 alloy, the elongation can be reduced from 8% to 2% when the thickness of the castings is increased from 5 mm to 40 mm. Therefore, there is an essential need for improving the mechanical properties of the commercially available cast aluminium alloys at ambient temperature and at elevated temperatures, in particular to increase the strength without sacrificing the ductility. It is equally important to produce aluminium castings with much reduced sensitivity of the mechanical properties to the casting wall thickness.

The present invention seeks to provide an improved method for forming an alloy. Preferably, the yield strength of cast aluminium alloys is increased by at least 20% at room temperature and high temperature at 250° C., while the elongation is still maintained a same level of existing materials.

In accordance with a first aspect of the invention, there is provided a method for improving the mechanical properties of a cast aluminium alloy, including the steps of:

(a) providing an aluminium alloy;

(b) introducing into said alloy at least one of the elements nickel, silver, niobium, molybdenum, cerium, lanthanum, yttrium, or scandium, wherein the amount of each of said at least one elements is from 0.1 wt % to 0.5 wt %; and (c) introducing into said alloy at least one of the compounds $TiB_2$, TiC or $Al_2O_3$ or components to form at least one of said compounds in said alloy wherein the amounts of said compounds in the alloy are as follows:

(i) $TiB_2$ from 0.02 wt % to 0.2 wt %

(ii) TiC from 0.02 wt % to 0.3 wt %

(iii) $Al_2O_3$ from 0.02 wt % to 0.5 wt %.

Minor chemical elements are introduced into the existing aluminium alloys. The introduced elements include at least one of nickel, silver, niobium, molybdenum, cerium, lanthanum, yttrium, and scandium. The addition levels are generally at a level of more than 0.1 wt. % but less than 0.5 wt. %, in particular more than 0.1 wt. % but less than 0.3%, for each of the added element on top of the existing levels in the alloys.

The method preferably forms at least one type of sub-micron-sized/or nano-sized $TiB_2$, TiC and $Al_2O_3$ solid particles in the solidified castings. The solid phases may be formed as prior phase or as eutectic phase during solidification. The solid phases may be controlled to exhibit a granular morphology with specified particle sizes and distribution, which are typically at sub-micro and/or nano levels distributing uniformly in the matrix. The fraction of these sub-micro particles are generally more than 0.05% but less than 0.5%, preferably more than 0.1% but less than 0.3%, or even preferably less than 0.2% in the castings.

The method seeks to obtain finer precipitates than that of the commercial Al alloy, which will benefit the tensile strengths significantly. This may be accelerated by the introduction of sub-micro and/or nano-sized $TiB_2$, TiC and $Al_2O_3$ particles.

The acceptable starting materials are generally the commercial cast aluminium alloys with specified compositions. After melting of the commercial alloys, at least one from the elements such as nickel, silver, niobium, molybdenum, cerium, lanthanum, yttrium, and scandium is added into the melt. The concentration of the added elements is varied according to the specification of the commercial alloys and the applications of the final alloys. However, the additions of each element mentioned-above is less than 0.5%, preferably less than 0.3%.

The alloy may be simultaneously modified by at least one type of sub-micron-sized $TiB_2$, TiC and $Al_2O_3$ solid particles in the castings after solidification. Although the solid particles can be generated and introduced into castings by several ways, the preferred method is in-situ synthesis during alloy manufacturing, which provides significantly improved efficiency in terms of strengthening by dispersed secondary phase particles, and the modification of grain structure as well, in comparison with that obtained through the addition of conventional master alloys. During melting, the essential elements added in the melt will chemically react each other to provide fine sub-micron-sized solid phase particles in the castings. The fraction of these sub-micron-sized particles are generally less than 0.5%, preferably less than 0.3%, or even preferably less than 0.2% in the castings. For example, the alloys can contain sufficient Ti and B to form $TiB_2$ particles during solidification. The method of introducing Ti and B can be different, but the salts-metal reaction by adding $K_2TiF_6$ and $KBF_4$ mixed salts into the Al melt is preferred for in situ synthetization of $TiB_2$ particles. The $TiB_2$ particles synthesized by salt reaction can be sub-micron- and/or even nano-sized. In the case of forming $Al_2O_3$ in the aluminium melt, it is preferred to input $O_2$ or $O_2$-riched air into the aluminium melt to generate fine $Al_2O_3$ particles. And in the case of forming TiC particles, it is preferred to introduce the mixture powders of Ti and carbon into the melt and to form in-situ fine TiC particles. And in the case of forming TiC and $TiB_2$ particles simultaneously, it is preferred to introduce the mixture powders of $K_2TiF_6$ and $B_4C$ into the melt and to form in-situ fine $TiB_2$ and TiC particles.

It needs to be emphasised that the improvement of the mechanical properties is preferably achieved by the combination of minor elements, which are for enhancing the precipitation strengthening in the alloys, and the essential elements, which are to provide fine solid particles to achieve further secondary phase strengthening, and the enhancement of precipitation strengthening via the acceleration of the in-situ particles. The improvements in the mechanical properties is not only at ambient temperature, but also at the elevated temperatures.

On the other hand, the $TiB_2$, TiC and $Al_2O_3$ solid particles are commonly introduced as reinforcements in metal matrix composites (MMCs). In the present invention, however, the volume fraction of these particles is preferably much lower in comparison with that in MMCs. Therefore, the addition of trace amount of the particles will enhance the ductility of the materials, rather than the negative effect of particles on the ductility of the MMCs. It needs to be emphasised that the $TiB_2$ is an effect grain refiner when properly applied into cast aluminium alloys. However, as described before, the amount of $TiB_2$ for grain refinement is much less than that used in the present invention. Accordingly, the alloys of the present invention gain their strength from using amounts of $TiB_2$, TiC and $Al_2O_3$ which are greater than the small amounts used for grain refining (and are therefore not at levels at which they are dissolved in the alloy) but are not at levels as high as those used in MMCs.

A number of preferred embodiments of the invention will be better understood by reference to the following examples, which are offered by the way of illustration only, and the one skilled in the art will be recognized as not to be limiting.

EXAMPLE 1

Purpose: To increase the strength in the commercial A356 alloy.

A commercial A356 alloy is used as the starting material. The A356 alloy in the embodiments nominally comprises, in weight percentage, 7.0% Si, 0.02% Cu, 0.36% Mg, 0.12% Fe, 0.12% Ti. The original A356 alloy was melted and cast into the mould designed according to ASTM procedures B557 by gravity casting to obtain a number of standard tensile samples. The samples were subjected to a T6 heat treatment at 535±5° C. for 8 hour solutionising and followed by quench into hot water at 60° C. and aged at 165±5° C. for 8 hours. At least ten samples were tested and the average of the value was taken as the baseline properties of the A356 alloy.

In the embodiment, the same A356 alloy as above was melted in a graphite crucible, the proper amounts of commercial Al-2% Sc, and Al-10% La were carefully weighted and added into melt, and then 0.7 wt. % of $K_2TiF_6$ and 0.72 wt. % $KBF_4$ mixed salts (based on the weight of A356 alloy) were added to the alloy melt holding at 800° C. for 30 minutes, where 0.2% of $TiB_2$ was supposed to be added in the alloy assuming that Ti and B are reacted fully to form $TiB_2$. The alloy was analysed by ICP and the final composition is 7.0% Si, 0.02% Cu, 0.36% Mg, 0.12% Fe, 0.12% Ti, 0.1% Sc, 0.15% La, 0.19% $TiB_2$. The alloy was cast into the mould designed according to ASTM procedures B557 by gravity casting to obtain a number of standard tensile samples. The samples were subjected to a T6 heat treatment at 535±5° C. for 8 hour solutionising and followed by quench into hot water at 60° C. and aged at 165±5° C. for 8 hours. The detail comparison of mechanical properties under as-cast condition and under T6 heat treated conditions is shown in Table 1. With respect to the alloy embodiment in example 1, it is obvious that the embodiment alloy exhibited a better combination of tensile strength and elongation compared to that of the commercial A356 alloy. In particular, the elongation of the embodiment alloy was 3 times higher than that of the A356 alloy.

FIG. 1 describes the grain structure of A356 (a), Embodiment 1 (b) and the $TiB_2$ particles in Embodiment 1(c)

TABLE 1

Mechanical properties of gravity castings made by two alloys.

| | | Yield strength (Rp0.2/MPa) | Ultimate tensile strength (Rm/MPa) | Elongation (δ/%) |
|---|---|---|---|---|
| Embodiment 1 | As-cast | 100 | 200 | 5.0 |
| | T6 | 320 | 385 | 8.0 |
| A356 | As-cast | 90 | 160 | 4.0 |
| | T6 | 240 | 285 | 5.0 |

EXAMPLE 2

Purpose: to increase the yield strength and elongation of LM5 aluminium alloy

A commercial LM5 alloy is used as the starting material. The LM5 alloy in the embodiment nominally comprise, in weight percentage, 0.3% Si, 5.2% Mg, 0.5% Mn, 0.05% Cu, 0.26% Fe, 0.11% Ti. The original LM5 alloy was melt and cast into the mould designed according to ASTM procedures B557 by gravity casting to obtain a number of standard tensile samples. At least ten samples were tested and the average of the value was taken as the baseline properties of the LM5 alloy.

In the embodiment, after the same LM5 alloy as above was melt in a graphite crucible, the proper amounts of commercial Al-10% Zr, Al-10% La and silver metals were carefully weighed and added into melt. Then 0.24 wt. % of Ti and 0.06 wt. % carbon mixed powders (based on the weight of LM5 alloy) were added to the alloy melt holding at 850° C. for 120 minutes, where 0.3% of TiC was supposed to be added in the alloy assuming that Ti and C are reacted fully to form TiC. The alloy was analysed by ICP and the final composition is 0.3% Si, 5.3% Mg, 0.5% Mn, 0.05% Cu, 0.25% Fe, 0.12% Ti, 0.1% Ag, 0.1% La, 0.15% Zr, 0.3% TiC, and the balanced aluminium and incidental impurities (embodiment 2 of the invention). The alloy was cast into the mould designed according to ASTM procedures B557 by gravity casting to obtain a number of standard tensile samples. All the samples were tested at as-cast state.

With respect to the alloy embodiment in example 2, it is obviously that the test samples of the alloy exhibited a better combination of tensile strength and elongation compared to that of LM5 alloy.

Figure 2:
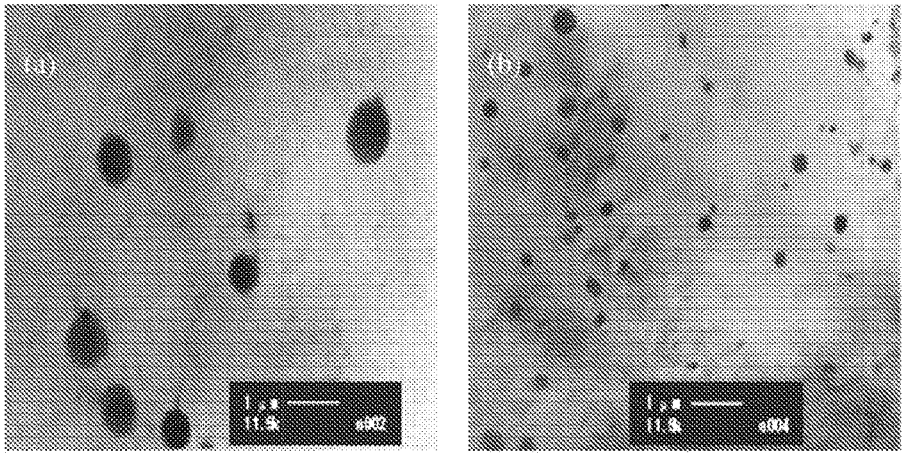
FIG. 2 is a pair of photomicrographs comparing the size and morphology of the precipitation of $Mg_2Si$ in LM5 alloy (panel a), and Embodiment 2 alloy (panel b) showing that introduction of TiC particles resulted in a significant decrease in the size of $Mg_2Si$ precipitation.

FIG. 2 describes the comparison of the size and morphology of the precipitation of $Mg_2Si$ in LM5 alloy (a), and Embodiment 2 alloy (b) showing that introduction of TiC particles resulted in a significant decrease in the size of $Mg_2Si$ precipitation.

TABLE 2

Illustration of the mechanical properties results of gravity casting samples.

| | Yield strength (Rp0.2/MPa) | Ultimate tensile strength (Rm/MPa) | Elongation (δ/%) |
|---|---|---|---|
| Embodiment 2 | 160 | 265 | 8 |
| LM5 | 120 | 195 | 5 |

EXAMPLE 3

Purpose: to increase the yield strength and elongation of A206 aluminium alloys

An alloy in accordance with the invention nominally comprises, in weight percentage, 5.0% Cu, 0.3% Mg, 0.4% Mn, 0.3% Ti, 0.08% Fe, 0.3% Ag, 0.5% Y, 0.05% V, 0.05% Sc, 0.2% $TiB_2$ and the balanced aluminium and incidental impurities (embodiment 3 of the invention).

Figure 3:
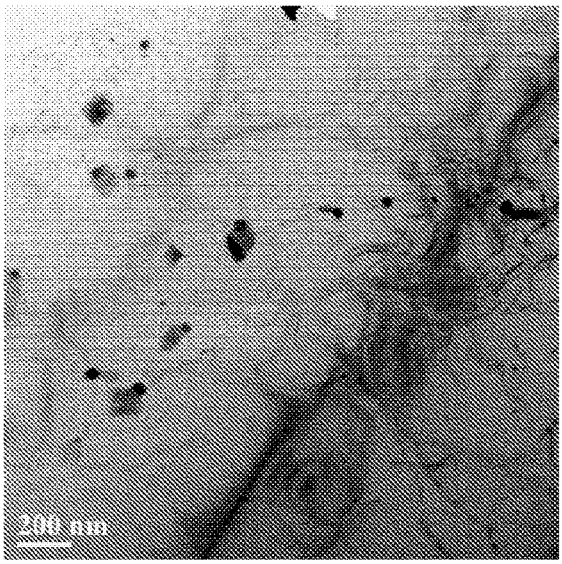
FIG. 3 is a photomicrograph showing the nano-sized $TiB_2$ particles of Embodiment 3 alloy in the present invention.

The alloy in question was obtained by carefully weighing and mixing the proper amounts of commercial A206 alloy, Al-10% V, A1-2% Sc, $K_2TiF_6$ and $KBF_4$ salts and silver and yttrium metals by the steps as described in example 1. The melt treatment, casting and tensile testing were the same as that described in example 1 previously. For comparison, a commercial A206 alloy comprising 5.0% Cu, 0.3% Mg, 0.4% Mn, 0.3% Ti, 0.08% Fe was melt and cast into the same mould via a similar approach to produce test bars. All the test samples were subjected to the T6 heat treatment (solution at 525±5° C. for 2 hours, then quenched into hot water of 60° C., then aged at 155±5° C. for 8 hours). FIG. 3 shows the Nano-sized $TiB_2$ particles of Embodiment 3 alloy in the present invention.

TABLE 3

Illustration of the mechanical properties results of gravity casting samples.

| | Yield strength (Rp0.2/MPa) | Ultimate tensile strength (Rm/MPa) | Elongation (δ/%) |
|---|---|---|---|
| Embodiment 3 | 500 | 540 | 5.5 |
| A206 | 420 | 485 | 3 |

With respect to the alloy embodiment in example 3, it is obviously that the test samples of the alloy exhibited a better combination of tensile strength and elongation compared to that of A206 alloy. The value of yield strength and ultimate tensile strength was increase by 20% than that of the A206 alloy.

EXAMPLE 4

Purpose: to increase the yield strength and elongation of LM24 aluminium alloys

An alloy in accordance with the invention nominally comprises, in weight percentage, 8.7% Si, 3.3% Cu, 0.5% Mg, 1.6% Zn, 0.9% Fe, 0.05% Ti, 0.8% Mn, 0.08% Cr, 0.1% Nb, 0.1% La, 0.05% Zr, 0.5% $Al_2O_3$, and the balance aluminium and incidental impurities (embodiment 4 of the invention). The embodiment in question was prepared by melting the commercial LM 24 alloy in graphite crucible. The proper amounts of Al-10% Zr, Al-10% La, niobium metal were then added into the melt, and then the $O_2$ was introduced into the melt at 800° C. for 15 minutes via Fe pipe, where 0.5% of $Al_2O_3$ was supposed to be added into melt. The tensile samples of 6.35 mm in diameter were prepared by high pressure die casting (HPDC). For comparison, a commercial of LM24 alloy comprising 8.7% Si, 3.3% Cu, 0.5% Mg, 1.6% Zn, 0.9% Fe, 0.05% Ti, 0.8% Mn, 0.08% Cr was melt and cast via a similar approach to produce test bars. All the test samples were tested at as-cast state.

Figure 4:
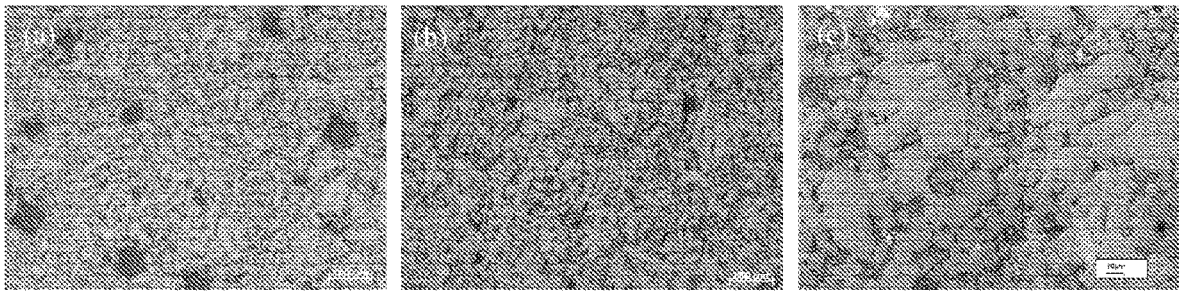
FIG. 4 is a series of photomicrographs showing the microstructure of LM24 (panel a) and embodiment 4 (panel b), and the distribution of $Al_2O_3$ particles (panel c).

FIG. 4 describes the microstructure of LM24 (a) and embodiment 4 (b), and the distribution of $Al_2O_3$ particles (c).

TABLE 4

Illustration of the mechanical properties results of HPDC casting samples.

| | Yield strength (Rp0.2/MPa) | Ultimate tensile strength (Rm/MPa) | Elongation (δ/%) |
|---|---|---|---|
| Embodiment 4 | 185 | 320 | 4.0 |
| LM24 | 135 | 285 | 3.5 |

With respect to the alloy embodiment in example 4, it is obviously that the test samples of the alloy exhibited a better combination of tensile strength and elongation compared to that of commercial LM24. The value of yield strength of embodiment alloy was increased by 50% than that of LM24 alloy.

EXAMPLE 5

Purpose: to improve the mechanical properties Mahle 174 alloy at elevated temperatures An alloy of the embodiments nominally comprises, in weight percentage, 12.5% Si, 5% Cu, 2% Ni, 0.8% Mg, 0.15% Fe, 0.12% Ti, 0.3% Mn, 0.15% Cr, 0.12% Zr, 0.2% V, 0.1% Nb, 0.2% La, 0.2% Ce, 0.1% Y, 0.5% $TiB_2$, 0.21 wt % TiC, and the balanced aluminium and incidental impurities (embodiment 5 of the invention). The proper amounts of commercial Mahle 174 alloy, Al-10% La, Al-10% Ce master alloys and niobium and yttrium metal were carefully weighted and melt in the graphite crucible. Then 2.57% of $K_2TiF_6$ and 0.2% $B_4C$ mixed powders (based on the weight of Mahle 174 alloy) were added to the alloy melt holding at 900° C. for 120 minutes, where 0.5% of $TiB_2$ and 0.21% of TiC was supposed to be added in the alloy assuming that Ti and $B_4C$ are reacted fully to form TiC and $TiB_2$. The alloy was cast into the mould designed according to ASTM procedures B557 by gravity casting to obtain a number of standard tensile samples. For comparison, a Mahle174 alloy (12.5% Si, 5% Cu, 2% Ni, 0.8% Mg, 0.15% Fe, 0.12% Ti, 0.3% Mn, 0.15% Cr, 0.12% Zr, 0.2% V) was melted and cast into the same mould via a similar approach to produce test bars. All the test samples were subjected to the T6 heat treatment (solution at 510±5° C. for 2 hours, then quenched into hot water of 60° C., then aged at 170±5° C. for 8 hours).

TABLE 5

Illustration of the mechanical properties results of gravity casting samples.

| | Testing temperature | Ultimate tensile strength (Rm/MPa) | Elongation (δ/%) |
|---|---|---|---|
| Embodiment 5 | Room temperature | 380 | 0.5 |
| | 350° C. | 105 | 3.0 |
| Mahle 174 | Room temperature | 320 | 0.5 |
| | 350° C. | 80 | 5.0 |

With respect to the alloy embodiment in example 5, it is obviously that the test samples of the alloy exhibited a better combination of room temperature and elevated temperatures tensile strength compared to that of Mahle174 alloy.

Figure 5:
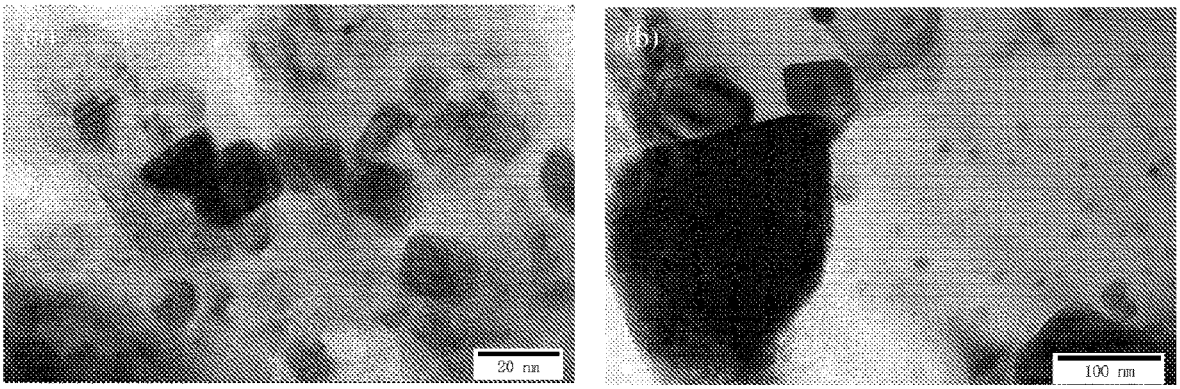
FIG. 5 is a pair of photomicrographs showing the morphology and size of $TiB_2$ (panel a) and TiC (panel b) particles of embodiment 5.

FIG. 5 describes the morphology and size of $TiB_2$ and TiC particles of embodiment 5.

In accordance with a further aspect of the invention, there is provided a method and process to improve the mechanical properties of commercial cast aluminium alloys are achieved by introducing minor chemical elements into the existing aluminium alloys, including at least one of the elements nickel, silver, niobium, molybdenum, cerium, lanthanum, yttrium, vanadium, zirconium, chromium, and scandium at a level of more than 0.1 wt. % but less than 0.5 wt. % on top of the existing levels in the alloy, and by introducing the essential elements to form at least one type of sub-micron sized or even nano-sized $TiB_2$, TiC and $Al_2O_3$ solid particles at a level of more than 0.05 wt. % but less than 0.5 wt. % in the solidified castings.

The aluminium alloys are preferably commercially available cast aluminium alloys.

A microstructure of the aluminium alloy preferably includes both insoluble solidified particles and precipitated particles.

The added elements may include at least one of nickel, silver, niobium, molybdenum, cerium, lanthanum, yttrium, vanadium, zirconium, chromium, and scandium at a preferred level of less than 0.3 wt. % on top of the existing levels in the alloy.

The added elements may form at least one type of sub-micron-sized or nano-sized $TiB_2$, TiC and $Al_2O_3$ solid particles at a preferred level of less than 0.3 wt. % in the solidified castings.

The elements may form at least one type of sub-micro $TiB_2$, TiC and $Al_2O_3$ solid particles at a preferred level of less than 0.2 wt. % in the solidified castings.

The $TiB_2$, TiC and $Al_2O_3$ solid particles are preferably nano-sized in the solidified castings.

The $TiB_2$ particles are preferably generated by a salts-metal reaction through the added $K_2TiF_6$ and $KBF_4$ salts into the alloy melt for in situ synthetization of $TiB_2$ particles.

The $TiB_2$ particles can be in-situ formed in melt as the prior solid phase during solidification or can be the in-situ particles introduced into the melt via the master alloy.

The $Al_2O_3$ particles are preferably generated by inputting $O_2$ or $O_2$– riched air into the aluminium melt to form fine $Al_2O_3$ particles. The TiC particles are preferably generated by inputting mixture powders of Ti and carbon.

The $TiB_2$ and TiC particles are preferably generated by a chemical reaction through the added $K_2TiF_6$ salts and $B_4C$ powders into the alloy melt for in situ synthetization of $TiB_2$ and TiC particles simultaneously.

The disclosures in British patent application numbers 1701667.6 and 1712765.5, from which this patent application claims priority, and in the abstract accompanying this application, are incorporated herein by reference.

The invention claimed is:

1. A method for improving the mechanical properties of a cast aluminium alloy, including the steps of:

(a) providing an aluminium alloy;

(b) introducing into said alloy at least one of the elements nickel, silver, niobium, molybdenum, cerium, lanthanum, yttrium, or scandium, wherein the amount of each of said at least one elements is from 0.1 wt % to 0.5 wt %; and (c) introducing into said alloy at least one of the compounds $TiB_2$, TiC or $Al_2O_3$ or components to form at least one of said compounds in said alloy wherein the amounts of said compounds in the alloy are as follows:

(i) $TiB_2$ from 0.02 wt % to 0.2 wt %

(ii) TiC from 0.02 wt % to 0.3 wt %

(iii) $Al_2O_3$ from 0.02 wt % to 0.5 wt %;

wherein the amounts of said compounds in the alloy are as follows:

(i) $TiB_2$ from 0.05 wt % to 0.1 wt %

(ii) TiC from 0.05 wt % to 0.1 wt %

(iii) $Al_2O_3$ from 0.05 wt % to 0.1 wt %.

2. A method as claimed in claim 1, wherein the level of each compound of step (c) is less than 0.1 wt %.

3. A method for improving the mechanical properties of a cast aluminium alloy, including the steps of:

(a) providing an aluminium alloy;

(b) introducing into said alloy at least one of the elements nickel, silver, niobium, molybdenum, cerium, lanthanum, yttrium, or scandium, wherein the amount of each of said at least one elements is from 0.1 wt % to 0.5 wt %; and (c) introducing into said alloy at least one of the compounds $TiB_2$, TiC or $Al_2O_3$ or components to form at least one of said compounds in said alloy wherein the amounts of said compounds in the alloy are as follows:

(i) $TiB_2$ from 0.02 wt % to 0.2 wt %

(ii) TiC from 0.02 wt % to 0.3 wt %

(iii) $Al_2O_3$ from 0.02 wt % to 0.5 wt %;

wherein $TiB_2$ in step (c) is formed by adding $K_2TiF_6$ and $KBF_4$ salts into the alloy for in situ synthetization of $TiB_2$ particles.

4. A method as claimed in claim 3, wherein the $TiB_2$ particles of step (c) are introduced into the alloy via a master alloy.

5. A method for improving the mechanical properties of a cast aluminium alloy, including the steps of:

(a) providing an aluminium alloy;

(b) introducing into said alloy at least one of the elements nickel, silver, niobium, molybdenum, cerium, lanthanum, yttrium, or scandium, wherein the amount of each of said at least one elements is from 0.1 wt % to 0.5 wt %; and (c) introducing into said alloy at least one of the compounds $TiB_2$, TiC or $Al_2O_3$ or components to form at least one of said compounds in said alloy wherein the amounts of said compounds in the alloy are as follows:

(i) $TiB_2$ from 0.02 wt % to 0.2 wt %

(ii) TiC from 0.02 wt % to 0.3 wt %

(iii) $Al_2O_3$ from 0.02 wt % to 0.5 wt %;

wherein the TiC of step (c) is formed by introducing into the alloy titanium and carbon in powder form.

6. A method for improving the mechanical properties of a cast aluminium alloy, including the steps of:

(a) providing an aluminium alloy;

(b) introducing into said alloy at least one of the elements nickel, silver, niobium, molybdenum, cerium, lanthanum, yttrium, or scandium, wherein the amount of each of said at least one elements is from 0.1 wt % to 0.5 wt %; and (c) introducing into said alloy at least one of the compounds $TiB_2$, TiC or $Al_2O_3$ or components to form at least one of said compounds in said alloy wherein the amounts of said compounds in the alloy are as follows:

(i) $TiB_2$ from 0.02 wt % to 0.2 wt %

(ii) TiC from 0.02 wt % to 0.3 wt %

(iii) $Al_2O_3$ from 0.02 wt % to 0.5 wt %;

wherein the $TiB_2$ and TiC of step (c) are formed by adding $K_2TiF_6$ and $B_4C$ into the alloy.

7. A method as claimed in claim 6, wherein the amount of each element in step (b) is less than 0.3 wt %.

* * * * *